US007591632B2

(12) United States Patent
Baecke et al.

(10) Patent No.: US 7,591,632 B2
(45) Date of Patent: Sep. 22, 2009

(54) SIDE CHANNEL COMPRESSOR WITH HOUSING SHELLS AND RUNNING WHEEL

(76) Inventors: Martin Baecke, Linden Str. 7, Dessau (DE) 06847; Peter Hartung, Fuchsweg 6, Halle/Saale (DE) 06120; Iugo Müller, Helene-Meier-Str. 9, Dessau (DE) 06844

( * ) Notice: Subject to any disclaimer, the term of this patent is extended or adjusted under 35 U.S.C. 154(b) by 239 days.

(21) Appl. No.: 11/786,451

(22) Filed: Apr. 11, 2007

(65) Prior Publication Data

US 2007/0231121 A1 Oct. 4, 2007

Related U.S. Application Data

(63) Continuation of application No. PCT/DE2005/001779, filed on Oct. 5, 2005.

(30) Foreign Application Priority Data

Oct. 12, 2004 (DE) ..... 10 2004 049 613

(51) Int. Cl.
*F04D 5/00* (2006.01)
*F04D 29/24* (2006.01)
*F04D 29/40* (2006.01)

(52) U.S. Cl. ..... 415/131; 415/173.1; 415/55.1; 415/214.1; 415/126; 415/178; 415/224; 416/203; 416/206

(58) Field of Classification Search ..... 415/55.1, 415/214.1, 224, 131, 140, 141, 78, 178, 126, 415/173.1; 416/203, 206; 417/423.14
See application file for complete search history.

*Primary Examiner*—Ninh H Nguyen
(74) *Attorney, Agent, or Firm*—Clement Cheng

(57) ABSTRACT

The invention relates to a side channel compressor, comprising a housing shell and a running wheel. The running wheel is mounted to be rotatable with respect to the housing shell to provide two annular sealing areas between the housing shell and the running wheel. The housing shell between the first and the second sealing area can be made of one piece. The gap dimensions of the first and second sealing areas can be adjusted by means of a disc spring/nut system or a wobble means. A fan impeller may be fixed on the motor shaft, and the housing shell can comprise cooling ribs, wherein the cooling ribs are arranged and formed such that the air conveyed by the fan impeller sweeps through the cooling ribs. One of the annular sealing areas can include a dead volume chamber. The housing shell may be a casting or a machined extruded profile.

16 Claims, 4 Drawing Sheets

SIDE CHANNEL COMPRESSOR WITH HOUSING SHELLS AND RUNNING WHEEL

CROSS REFERENCE TO RELATED CO-PENDING APPLICATIONS

This application is a continuation of international application number PCT/DE 2005/001779 (publication number: WO 2006/039894 A2) filed on Oct. 5, 2005 and entitled SIDE CHANNEL COMPRESSOR AND HOUSING SCHELLS AND ROTOR THEREFOR (the contents of which are expressly incorporated herein by reference) which claims the benefit of the above-mentioned international application and the corresponding German national patent application number 10 2004 049 613.7 filed on Oct. 12, 2004 and entitled SEITENKANALVERDICHTER SOWIE GEHÄUSESCHALEN UND LAUFRAD HIERFÜR the contents of which are expressly incorporated herein by reference.

FIELD OF THE INVENTION

The field of the invention relates to compressors, especially to side channel compressors and running wheels therefor.

BACKGROUND OF THE INVENTION

Side channel compressors, housing shells and running wheels according to the preambles of the independent claims are known, for example, from WO 00/68577 A1.

In a side channel compressor, a channel is enclosed by a housing and a running wheel. Blades are mounted on the running wheel, which project into the channel, but do not completely fill in the same. Seen in the direction of rotation of the running wheel an inlet to the channel is provided ahead of an outlet from the channel. The channel comprises two regions, namely one passed through by the blades of the running wheel, and the side channel which is not passed through by the blades. An interrupter closing the side channel is provided between the inlet and the outlet. The effective length of the interrupter has to be slightly longer than a blade distance.

The boundary surface between the side channel and the rest of the channel is frequently a plane perpendicular to the axis of rotation of the running wheel or a conical surface the axis of which coincides with the axis of rotation of the running wheel.

A fluid, frequently a gas, in particular air, enters the channel through the inlet. A part of the fluid molecules is entrained by a blade in a tangential direction. Due to the centrifugal force the fluid molecules in question are also accelerated radially outwardly and thus flow out of the blade into the side channel where they are diverted in the direction of the running wheel and undergo a further acceleration by means of the running wheel. The fluid molecules are thus conveyed on a toroidally bent helical path from the inlet to the outlet while the pressure in the fluid increases. The interrupter is to minimize the amount of fluid dragged from the outlet to the inlet.

A noise-reducing side channel compressor is known from DE 42 39 814 C2. The noise reduction is obtained by the inlet opening having a flow area which is smaller than the cross-section of the inlet piece and smaller than the cross-section of the side channel, and by a continuous course of the transition between the different cross-sections. FIG. 1 of this document shows a housing provided with outer ribs.

DE 26 10 273 C3 deals with the optimization of the ratio of the blade cell volume to the sum of the blade volume plus blade cell volume. By this the gas quantity dragged over the interrupter is reduced and the efficiency is improved.

DE 199 55 955 A1 likewise deals with an improvement of the efficiency of a side channel machine. The constructive modifications merely relate to the blades.

WO 00/68577 A1 (=EP 1 177 384 A1) claiming the priority of DE 199 21 785 A1 also deals with the improvement of the efficiency of a side channel machine. To this end, a number of labyrinth seals for sealing the gap between the running wheel and the housing have been disclosed.

It is desirable to provide a cost-effective side channel compressor.

SUMMARY OF THE INVENTION

According to an embodiment of the invention a side channel compressor comprises a housing shell and a running wheel which is mounted to be rotatable with respect to the housing shell to provide two annular sealing areas between the housing shell and the running wheel. The housing shell between the first and the second sealing area is made of one piece and the housing shell is sealed against the ambiance by a lid having a small construction height. The running wheel is substantially located in the housing shell.

According to another embodiment of the invention a side channel compressor comprises a housing shell and a running wheel which is mounted to be rotatable with respect to the housing shell to provide two annular sealing areas between the housing shell and the running wheel. The gap dimensions of the first and second sealing areas are adjusted by means of a disc spring/nut system.

According to a further embodiment of the invention a side channel compressor comprises a housing shell and a running wheel which is mounted to be rotatable with respect to the housing shell to provide two annular sealing areas between the housing shell and the running wheel which is fixed to the shaft of a motor. The housing of the motor is fixed to the housing shell by means of screws and springs. By turning the screws the springs are more or less compressed and the position and orientation of the motor and the running wheel with respect to the housing shell is defined by the driving depth of the screws.

According to yet a further embodiment of the invention a housing shell for a side channel compressor has a honeycomb structure on its outside.

According to yet a further embodiment of the invention a side channel compressor comprises a housing shell and a running wheel which is mounted to be rotatable with respect to the housing shell to provide two annular sealing areas between the housing shell and the running wheel. At least one of the annular sealing areas includes a dead volume chamber.

According to yet a another embodiment of the invention a housing shell for a side channel compressor includes an edge surrounding a round cavity with such a depth that the cavity can receive a running wheel provided for the side channel compressor.

According to yet a further embodiment of the invention a running wheel for a side channel compressor is provided. The running wheel comprises two types of blades, namely functional blades and intermediate blades. The functional blades are slightly higher than the intermediate blades. The height of the functional blades is dimensioned such that the functional blades reach as far as the interrupter of the side channel compressor, with the exception of a sealing gap, if the running wheel is installed in a side channel compressor. The height of the intermediate blades is dimensioned such that a considerable gap is maintained between the intermediate blades and the interrupter of the side channel compressor, if the running wheel is installed in a side channel compressor.

Costs can particularly be saved with a structure being such that the housing can be made of one piece, namely the housing shell accommodating the side channel. A lid sealed with respect to the housing shell, which may be planar, reduces the leakage flow through the outer annular sealing area, protects the running wheel against contact and the contacting person against the running wheel.

A disc spring/nut system allows the adjustment of both gap dimensions of the two annular sealing areas to allow greater tolerances during the production while the gap losses remain within tolerable limits. This is particularly important for the production of small side channel compressors which have to provide a smaller gas flow than the commercial side channel compressors and which are therefore expected to have a smaller structural shape.

The direct attachment of the disk spring/nut system on a motor shaft saves additional bearings between the running wheel and the housing shell.

The attachment of the motor, e.g. by means of a wobble plate with springs and screws to the housing shell allows an even more precise adjustment of the gap dimension with respect to a disc spring/nut system.

The cooling of the side channel compressor may easily be improved by the attachment of a fan impeller at the end of the motor shaft facing away from the running wheel.

A honeycomb structure on the housing shell of the side channel compressor improves the rigidity of the housing shell and can additionally act as a heat sink if the side channel compressor is mounted to have the honeycomb structure facing upwardly. If the honeycomb structure has a predefined rigidity it moreover reduces the weight of the housing shell and the material consumption for the production of the housing shell.

Intermediate blades between the functional blades reduce the noise emission without affecting the conveying capacity of the side channel compressor.

BRIEF DESCRIPTION OF THE DRAWINGS

Preferred embodiments of the invention will hereinafter be explained in more detail with reference to the enclosed drawings, wherein like numerals represent like parts.

DETAILED DESCRIPTION OF THE INVENTION

Figure 1:
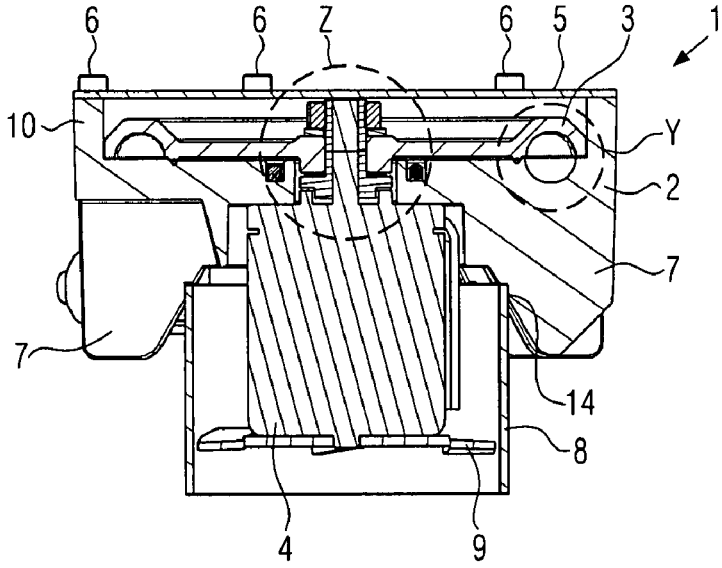
FIG. 1 shows a section through a side channel compressor with forced convection.
Figure 3:
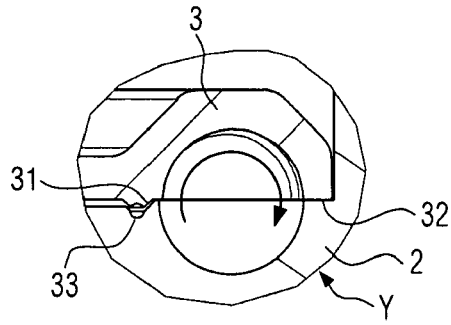
FIG. 3 shows a channel with a dead volume chamber sealing.
Figure 4:
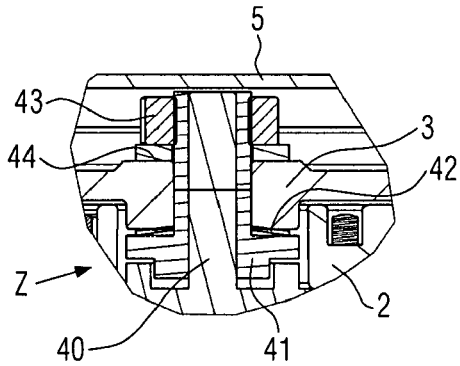
FIG. 4 shows a disc spring/nut system for adjusting the axial clearance.

FIG. 1 shows a section through a side channel compressor 1 according to the invention. The channel is located between the running wheel 3 and the housing shell 2 in region Y an enlargement of which is shown in FIG. 3. The housing of a motor 4 can be fixed directly to the housing shell 2. The running wheel 3 is fixed to the motor shaft in region Z by means of a disc spring/nut system. An enlargement of region Z is shown in FIG. 4. A lid 5 is fixed to the housing shell 2 by means of screws 6 and protects the running wheel 3, which rotates at more than 10,000 rpm, against contact.

The lid 5 may be leak-proof with respect to the housing shell 2. This reduces the leakage of the outer sealing area 32. In the space between the running wheel 3 and lid 5 a pressure is formed which ranges between the pressure at the inlet and the pressure at the outlet. Assuming that the pressure at the inlet corresponds approximately to the ambient pressure, lid 5 reduces the pressure difference at the sealing area 32 just ahead of the outlet so that the leakage flow is reduced correspondingly.

To allow lid 5 to be a component as simple as possible, which can, for example, be punched or cut out of a sheet, the housing shell 2 is provided with an edge 10. With the channel, the sealing areas, the cooling ribs and the inlet and outlet included, the housing shell 2 is a complex component anyway.

For the dissipation of heat the housing shell 2 may be provided with cooling ribs 7. To further improve the heat dissipation a fan impeller 9 may be mounted on the side of the motor shaft facing away from the running wheel 3. An air conduction pipe 8 makes the air conveyed by the fan impeller 9 sweep through the cooling ribs 7 as completely as possible. The air conduction pipe 8 may be clamped into notches 14 provided in the cooling ribs 7 which allows for a simpler assembly and disassembly of the air conduction pipe 8. In another embodiment the air conduction pipe 8 may also be attached adhesively.

Instead of the axial fan impeller 9 shown in FIG. 1 also a radial fan impeller may be used. The blades of a radial fan impeller are typically arranged between two discs, with one disc being driven and the other disc having a central hole through which air is aspirated. The outer radius of the driven disc is smaller than the inner radius of the ventilation pipe 8 by approximately the distance of the two discs. The outer radius of the disc with the hole is slightly smaller than the inner diameter of the ventilation pipe 8, and the ventilation pipe 8 is at least long enough to allow it to reach the disc with the hole and to leave a small gap between the disc with the hole and the ventilation pipe 8. The radius of the disc with the hole is uncritical, but its size may approximately be selected such that the area of the hole in the disc with the hole has approximately the same size as the clearance between the driven disc and the ventilation pipe 8.

Figure 2:
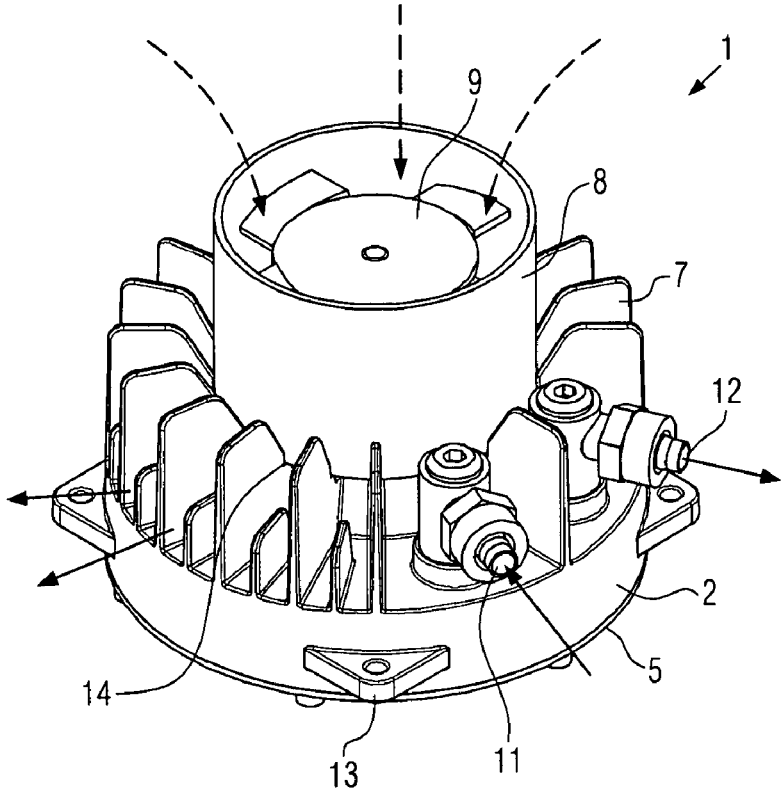
FIG. 2 shows a perspective view of the side channel compressor with forced convection illustrated in FIG. 1.

FIG. 2 shows a perspective view of the side channel compressor 1 illustrated in FIG. 1. Arrows indicate that cooling air is aspirated by the fan impeller 9, is conducted through the ventilation pipe 8 to the cooling ribs 7 and then flows through the cooling ribs 7 approximately radially out into the ambiance. FIG. 2 additionally shows an inlet 11 and an outlet 12 for the air conveyed by the running wheel 3 as well as fixing eyelets 13.

FIG. 3 shows an enlargement of region Y. The running wheel 3 and the housing shell 2 come particularly close to each other at the two sealing areas 31 and 32. At the inside sealing area 31 a dead volume chamber sealing 33 is provided as an example, which has the goal to possibly swirl the airflow flowing through the sealing gap between the running wheel 3 and the housing shell 2 so as to let the flow resistance of the sealing gap become as great as possible. If possible, there should be no flow filaments entering the next restriction.

As indicated by the arrow in FIG. 3 the air in the channel rotates clockwise. To reject this rotating airflow the sealing gap at the sealing area 31 extends from the channel towards the lower left before the sealing gap expands to the dead volume chamber 33. In other words, the orientation of the sealing is chosen such that the highest elevation is directed against the direction of movement of the air molecules.

The dead volume chamber has an approximately circular cross-section, with a smaller circle segment being cut out of the running wheel 3 and a larger circle segment being cut out of the housing shell 2. Corresponding to the course of the sealing gap the leakage flow enters the dead volume chamber from the right top, flows through it and encounters the housing shell 2 on the opposite side. By this, and by the movement of the running wheel 3 with respect to the housing shell 2, the air is swirled which enhances the sealing effect of the dead volume chamber.

The illustration of the dead volume chamber sealing 33 at the inside sealing area 31 is merely exemplary. It may be provided, alternatively or additionally, at the outside sealing area 32 substantially point-symmetrically to the center of the approximately circular channel cross-section.

FIG. 4 shows a first embodiment for region Z in an enlarged manner. One recognizes the running wheel receptacle 41 fixed to the motor shaft 40, for example, by means of an adhesive or interference fit. The disc spring 42 is clamped between a flange of the running wheel receptacle 41 and the running wheel 3. On its other side the running wheel 3 is pressed by shim 44 and nut 43 against the disc spring 42. By tightening or loosening the nut 43 with respect to the running wheel receptacle 41 the disc spring 42 is compressed to a greater or smaller extent and the sealing gap between the running wheel 3 and the housing shell 2 is decreased or increased, respectively. The guidance of the running wheel 3 is determined, above all, by the quality of fit between the running wheel 3 and the running wheel receptacle 41. The running wheel receptacle 41 and the running wheel 3 may engage each other in a form-closed manner. The form closure can be accomplished with noses or flattened parts.

Figure 5:
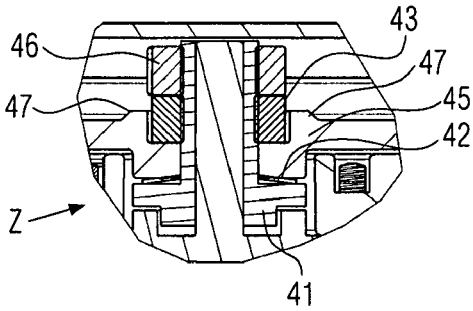
FIG. 5 shows a second embodiment of a disc spring/nut system.

FIG. 5 shows a second embodiment for region Z. This embodiment does not include the shim. Additionally provided is a locknut 46 to prevent an unintended loosening of the nut 43 during operation. The running wheel 45 includes a recess for the nut 43 so that the running wheel 45 may serve as a wrench during the assembly. This recess may be hexagonal so as to optimally transmit the torque to the nut 43. The recess may also be rectangular, with the short rectangle length corresponding to the across-flats dimension of the nut and with the effect of the recess then being comparable rather with an open-end wrench. It is even more important that the form closure between the nut 43 and the running wheel 45 together with the locknut 46 provides for a reliable torque transmission from the motor shaft 40 via the running wheel receptacle 41 to the running wheel so as to prevent a through-slip. In this embodiment, too, a fit is provided between the running wheel receptacle 41 and the running wheel 45.

Figure 6:
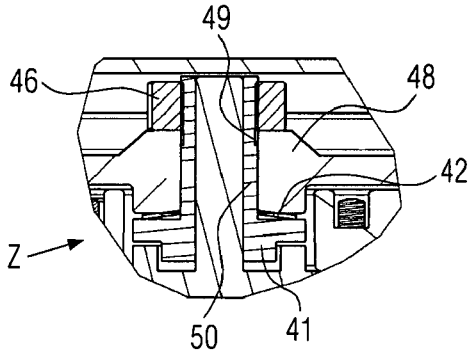
FIG. 6 shows a third embodiment of a disc spring/nut system.

FIG. 6 shows the third embodiment for region Z. In this embodiment the central hole in the running wheel 48 has a fit 50 in the lower portion and a thread 49 in the upper portion which replaces the nut 43. In another embodiment the thread 49 may also extend over the entire central bore in the running wheel 48.

To facilitate the adjustment of the sealing gap the end of the motor shaft 40 facing away from the running wheel 3, which projects over the motor housing or the fan impeller 9, may be square, hexagonal, at any rate not round.

Figure 7:
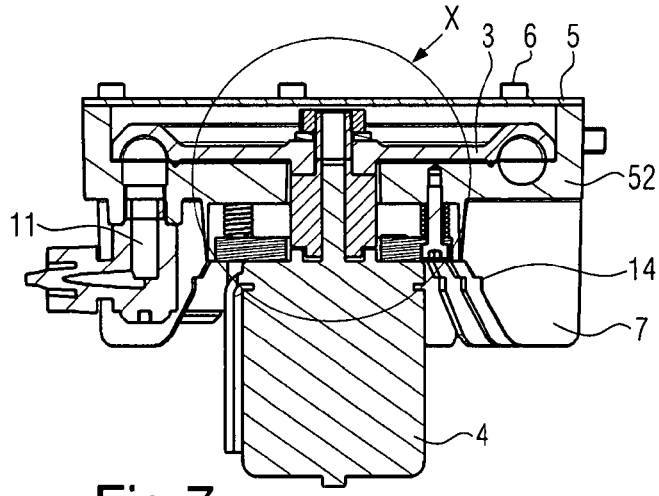
FIG. 7 shows a section through a side channel compressor with a wobble means.

FIG. 7 shows a section through another embodiment of a side channel compressor according to the invention. In the side channel compressor illustrated in FIG. 7 the fan impeller 9 and the air conduction pipe 8 are not mounted. However, the cooling ribs 7 are provided with notches 14 so that a ventilation pipe 8 is easy to attach. Also, the motor shaft projects over the motor housing downwardly so that also a fan impeller 9 may be fitted on. An enlargement of the interesting region X is illustrated in FIG. 8.

Figure 8:
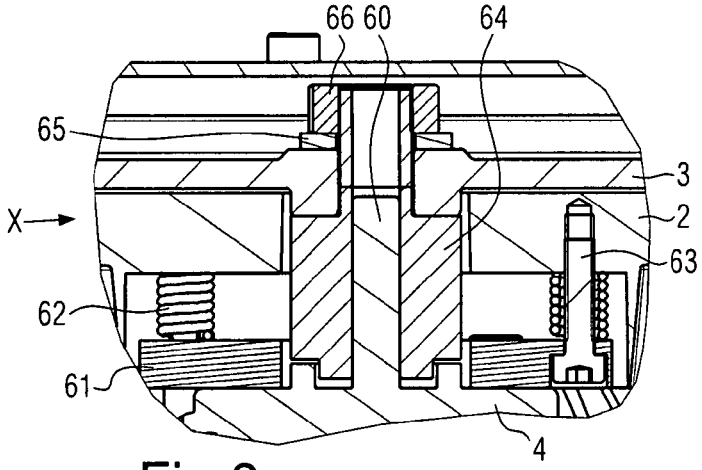
FIG. 8 shows a detailed view of the wobble means illustrated in FIG. 7.

FIG. 8 shows the attachment of the motor 4 by means of a wobble plate 61 to the housing shell 2. In this embodiment, too, the running wheel 3 is fixed to the motor shaft 60 by means of a running wheel receptacle 64, a shim 65 and a nut 66. A disc spring is dispensable because the gap dimensions can be adjusted by means of the adjusting screws 63, but it may be mounted additionally. The motor housing is fixed directly to the wobble plate 61, e.g. by means of an adhesive or screws. Springs 62 press the wobble plate 61 against the adjusting screws 63 thereby suppressing any clearance. The wobble plate 61, springs 62 and adjusting screws 63 may be called wobble means.

In another embodiment not illustrated the wobble plate 61 may be omitted. The heads of the adjusting screws 63 rest in stepped bores in the housing shell 2. The motor housing is provided with threaded holes for the adjusting screws. The springs 62 press the motor housing and the housing shell 2 apart against the adjusting screws 63 so as to obtain a tension and suppress any clearance. To facilitate the adjusting process the running wheel 3 is provided with through bores above the adjusting screws through which the heads of the adjusting screws are accessible.

Figure 9:
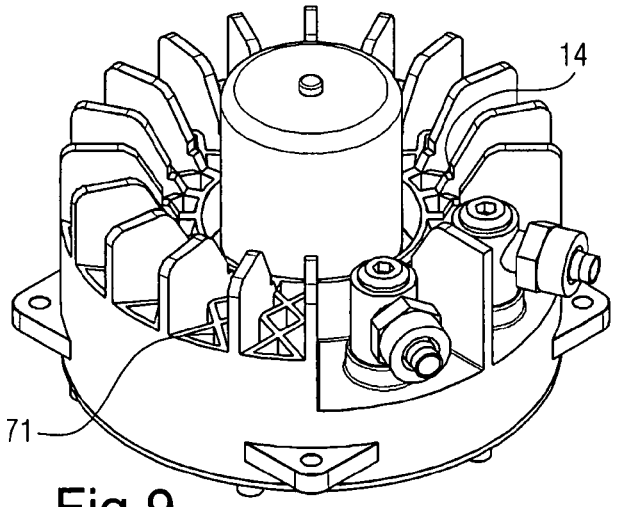
FIG. 9 shows a side channel compressor with a housing which has a stabilizing honeycomb structure.

FIG. 9 shows a perspective view of the side channel compressor illustrated in FIG. 7. Specifically the honeycomb structure 71 is illustrated, which provides the housing shell with additional stability, whereby a predefined stability leads to a material saving. If the honeycomb structure 71 has an upward orientation, which is the case in FIG. 9, allowing heated air to rise, the honeycomb structure supports the effect of the cooling ribs 7.

Figure 10:
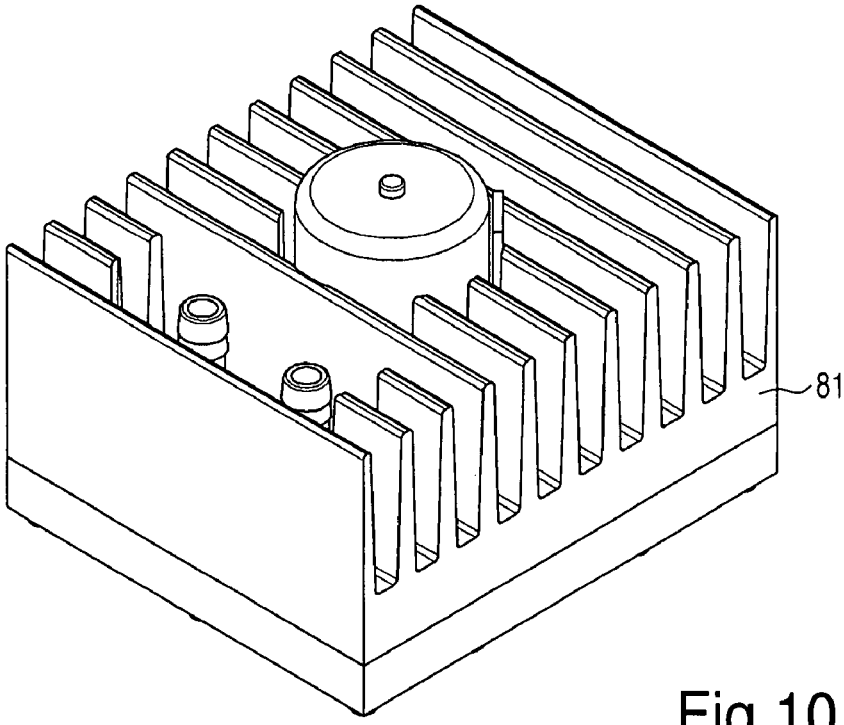
FIG. 10 shows a side channel compressor with a housing made of an extruded heat sink.

FIG. 10 shows another embodiment of a side channel compressor, in which the housing shell 81 is made of an extruded profile.

Figure 11:
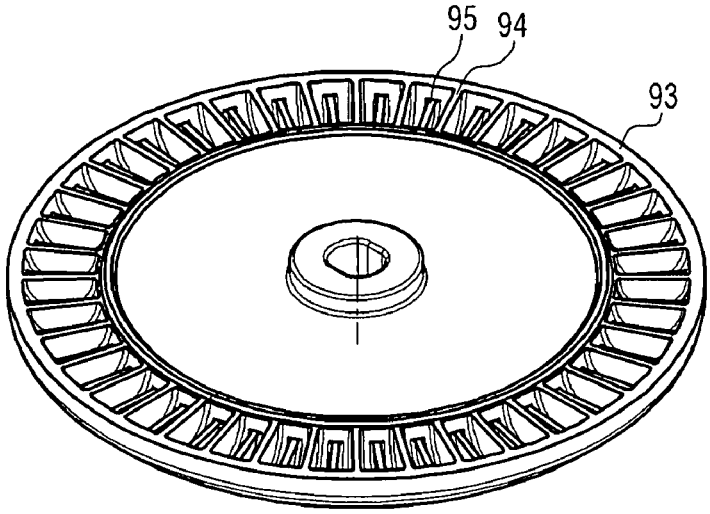
FIG. 11 shows a blade wheel with auxiliary blades.

FIG. 11 shows a running wheel 93 with functional blades 94 and intermediate blades 95. In an installed state of the running wheel 93 the functional blades 94 reach as far as the interrupter, with the exception of a sealing gap. In the installed state the intermediate blades 95 have a considerable distance to the interrupter. In one embodiment their height makes ⅔ of the height of the functional blades. The intermediate blades serve the noise reduction.

In another embodiment, specifically the edge of the interrupter on the outlet side is arranged obliquely with respect to the blades of the running wheel. This likewise serves the noise reduction. It is particularly advantageous to select the angle between this edge and the blades of the running wheel such that this edge passes over the space between the front edges of two adjacent blades. The border of the interrupter on the outlet side may also be composed of several edges. In the case of two edges this border is arrow-shaped. In the case of multiple edges this border is saw-shaped with a plurality of saw teeth. The particularly advantageous length of one blade distance of the edges in the tangential direction is thereby maintained.

The edge of the interrupter on the inlet side may extend as obliquely as the edge on the outlet side and may be composed of several edges. In this case, too, the preferred length in the tangential direction is one blade distance.

Although it was presumed in the foregoing that the side channel compressor according to the invention is, above all, employed for the conveyance of air, also other gases, or very generally even fluids, may be conveyed. Due to the small compressibility of liquids the problem that liquid dragged over the interrupter expands in the inlet area will not occur.

The invention was explained in more detail by means of preferred embodiments above. A person skilled in the art will appreciate, however, that various alterations and modifications may be made without departing from the spirit of the invention. Therefore, the scope of protection will be defined by the following claims and their equivalents.

LIST OF REFERENCE NUMERALS

1 side channel compressor
2 housing shell
3 running wheel
4 motor
5 lid
6 screw
7 cooling rib
8 air conduction pipe
9 fan impeller
10 edge
11 inlet
12 outlet
13 fixing eyelet
14 notch
31, 32 sealing area
33 dead volume chamber sealing
40 motor shaft
41 running wheel receptacle
42 disc spring
43 nut
44 shim
45 running wheel
46 lock nut
47 shoulder
48 running wheel
49 thread
50 fit
52 housing shell
60 motor shaft
61 wobble gate
62 spring
63 adjusting screw
64 running wheel receptacle
65 shim
66 nut
71 honeycomb structure
81 housing shell
93 running wheel
94 functional blade
95 intermediate blade
Z, Y, X regions

The invention claimed is:

1. A side channel compressor, comprising:

a housing shell;

a running wheel which is mounted to be rotatable with respect to the housing shell to provide two annular sealing areas between the housing shell and the running wheel;

the housing shell between the first and the second sealing area being made of one piece and the housing shell being sealed against an ambiance by a lid having a small construction height, the running wheel being substantially located in the housing shell, wherein the gap dimensions of the first and second sealing areas are adjusted by means of a disc spring nut system.

2. The side channel compressor according to claim 1, wherein the running wheel is fixed on a running wheel receptacle by means of a disc spring and a nut, wherein the running wheel receptacle comprises a thread for screwing on the nut, wherein the disc spring is clamped between a flange of the running wheel receptacle and the running wheel so that the disc spring presses the running wheel against the nut, wherein the running wheel is axially displaceable with respect to the running wheel receptacle by tightening or loosening the nut.

3. The side channel compressor according to claim 2, wherein the running wheel comprises a shoulder which produces a form closure with the nut and that a locknut is tightened with respect to the nut so as to ensure a torque transmission from the running wheel receptacle to the nut.

4. The side channel compressor according to claim 1, wherein the disc spring/nut system is fixed on the shaft of a motor, wherein the housing of the motor is fixed to the housing shell.

5. A side channel compressor, comprising:

a housing shell;

a running wheel which is mounted to be rotatable with respect to the housing shell to provide two annular sealing areas between the housing shell and the running wheel;

the housing shell between the first and the second sealing area being made of one piece and the housing shell being sealed against an ambiance by a lid having a small construction height, the running wheel being substantially located in the housing shell, wherein the running wheel is fixed to the shaft of a motor, wherein the housing of the motor is fixed to the housing shell by means of screws and springs such that by turning the screws the springs are more or less compressed and the position and orientation of the motor and the running wheel with respect to the housing shell is defined by the driving depth of the screws.

6. A side channel compressor, comprising:

a housing shell;

a running wheel which is mounted to be rotatable with respect to the housing shell to provide two annular sealing areas between the housing shell and the running wheel, the running wheel is fixed to the shaft of a motor, wherein the housing of the motor is fixed to the housing shell by means of screws and springs such that by turning the screws the springs are more or less compressed and the position and orientation of the motor and the running wheel with respect to the housing shell is defined by the driving depth of the screws.

7. The side channel compressor according to claim 6, wherein the housing of the motor is firmly connected to a wobble plate which is, in turn, connected to the housing shell by means of the screws and the springs.

8. The side channel compressor according to one of claim 6, wherein a fan impeller is fixed to the end of the motor shaft facing away from the running wheel and the housing shell comprises cooling ribs, wherein the cooling ribs are arranged and formed such that the air conveyed by the fan impeller sweeps through the cooling ribs.

9. The side channel compressor according to claim 8, wherein the housing shell has a honeycomb structure on its outside.

10. The side channel compressor according to claim 6, wherein the housing shell has a honeycomb structure on its outside.

11. The side channel compressor according to claim 6, wherein the housing shell has a honeycomb structure on its outside, wherein a running wheel is mounted to be rotatable with respect to the housing shell to provide two annular sealing areas between the housing shell and the running wheel.

12. The side channel compressor according to claim 6, wherein at least one of the annular sealing areas includes a dead volume chamber.

13. A running wheel for a side channel compressor comprising: two types of blades, namely functional blades and intermediate blades, wherein the functional blades are slightly higher than the intermediate blades, wherein the height of the functional blades is dimensioned such that the functional blades reach as far as the interrupter of the side channel compressor, with the exception of a sealing gap, if the running wheel is installed in a side channel compressor, wherein the height of the intermediate blades is dimensioned such that a considerable gap is maintained between the intermediate blades and the interrupter of the side channel compressor if the running wheel is installed in a side channel compressor.

14. The running wheel for a side channel compressor according to claim 13, further comprising a housing with a shell cast or machined extruded profile.

15. The running wheel for a side channel compressor according to claim 13, further comprising a housing shell with an edge surrounding a round cavity with such a depth that the round cavity can receive the running wheel provided for the side channel compressor.

16. The running wheel for a side channel compressor according to claim 13, further comprising a housing shell, wherein a running wheel is rotatably mounted with respect to the housing shell to provide two annular sealing areas between the housing shell and the running wheel.

* * * * *